United States Patent [19]

Eisenmann

[11] Patent Number: 4,666,382

[45] Date of Patent: May 19, 1987

[54] HYDROSTATIC GEAR RING MACHINE

[76] Inventor: Siegfried Eisenmann, Conchesstrasse 25, D-7960 Aulendorf, Fed. Rep. of Germany

[21] Appl. No.: 837,312

[22] Filed: Mar. 3, 1986

Related U.S. Application Data

[63] Continuation of Ser. No. 694,644, Jan. 24, 1985, abandoned.

[30] Foreign Application Priority Data

Jan. 26, 1984 [DE] Fed. Rep. of Germany ..... 3402710

[51] Int. Cl.[4] ..... F01C 1/10

[52] U.S. Cl. ..... 418/61 B

[58] Field of Search ..... 418/61 B

[56] References Cited

U.S. PATENT DOCUMENTS

| | | | |
|---|---|---|---|
| 3,453,966 | 7/1969 | Eddy | 418/61 B |
| 3,944,378 | 3/1976 | McDermott | 418/61 B |
| 4,484,870 | 11/1984 | Erasov | 418/61 B |

FOREIGN PATENT DOCUMENTS

| | | | |
|---|---|---|---|
| 38482 | 10/1981 | European Pat. Off. | 418/61 B |
| 73271 | 3/1983 | European Pat. Off. . | |
| 519555 | 7/1976 | U.S.S.R. | 418/61 B |
| 696180 | 11/1979 | U.S.S.R. | 418/61 B |

*Primary Examiner*—John J. Vrablik

*Attorney, Agent, or Firm*—Michael J. Striker

[57] ABSTRACT

A hydrostatic gear ring machine includes a hollow gear with an internal toothing and a central gear provided with an external toothing and rotated about a stationary axis whereas the hollow gear is rotated about the axis rotated about the axis of the central gear. The hollow gear has on its outer periphery an external toothing which is concentrical with its internal toothing and which is in mesh with the internal toothing provided on a housing. A distributor valve is provided, which includes a first control element and a second control element each having control openings closable by the other control element.

10 Claims, 8 Drawing Figures

HYDROSTATIC GEAR RING MACHINE

This is a continuation of application Ser. No. 694,644, filed Jan. 24, 1985, now abandoned.

BACKGROUND OF THE INVENTION

The present invention relates to a hydrostatic gear ring machine.

Gear ring pumps or motors, above mentioned as hydrostatic gear ring machines are known in the art. The hydrostatic gear ring machine of the type under discussion include a gear ring piston which generates reaction forces by means of a parallel crank gear or drive. If the shaft of such a machine is rotated by a motor the machine is operating as a pump; if, however the shaft of the machine is not driven by a motor but high-pressure liquid is fed to the inlet opening of the machine, and the liquid will rotate the gear ring and the pinion the machine will operate as a motor.

The above mentioned parallel crank gear imparts to the piston a circular movement with some amount of eccentricity, without however, permitting the ring-shaped piston to rotate independently relative to the housing of the machine. The parallel crank gear of conventional machines includes circular tooth gaps formed on the disc-shaped piston, and circular teeth which are formed as cylindrical pins on the housing. Such parallel crank gears are for example applied with the well known "Cyclo Gear". In conventional gear ring machines circular teeth gaps, in which the cylindrical pins are engaged, are each formed by one third of a circle. Therefore dimensions of the machine as well as expenses for the manufacture of its components are smaller.

As has been mentioned above the parallel crank gear of the known gear ring machine transmits all the reaction forces of the slow-running motor to the housing with high torques. Since the operational mesh angle of such parallel crank gear is very unfavorable the transmission of the high torques has a very bad effect on the housing and a fine rolling friction is not obtained in the parallel crank gear. Particularly during the start of the machine at high loads high friction losses occur in such gearing, which under circumstances can, together with friction losses occurring in the displacement gearing, forming chambers of different volumes, cause a self-jam or self locking in the interior of the machine. For this reasons slow-running gear ring piston machines are not suitable, for example in cable winches because there full loads must be easily manipulated on suspenders.

In such known machines the inner toothing, forming the displacement chambers, has in many positions a very unfavorable pressing angle so that high friction occurs in many angular positions if the machine is operating under high pressure loads and also under high torque loads.

Hydrostatic gear ring machines have been disclosed, for example in applicant's U.S. Pat. Nos. 4,398,874 and 4,432,732.

SUMMARY OF THE INVENTION

It is an object of the present invention to provide an improved hydrostatic gear ring machine.

It is another object of this invention to provide a machine in which high friction losses would be avoided due to the fact that high reaction torques on the housing are translated not by the parallel crank gear but by a very effective internal toothing. The pressing angle, with which peripheral forces act for translating torques, can be determined by the selection of the toothing. New trochoidal gearings are most suitable; however strongly corrected evolvent gearings are also possible.

The objects of the invention are attained by a hydrostatic gear ring machine, which can operate as a motor or a pump and comprises (a) a housing; a shaft positioned in said housing; a gear ring piston having an internal toothing and eccentrically positioned on said shaft;

(b) a central gear concentrically positioned on said shaft and connected thereto for joint rotation;

(c) said central gear having a toothing being in mesh with said internal toothing of the piston and having by one tooth less than said internal toothing so that chambers of variable volumes are formed between said internal toothing and the toothing of said central gear;

(d) said gear ring piston having an outer periphery provided with an external toothing concentrical with said internal toothing, said housing having an internal toothing concentrical with the central gear and being in mesh with the external toothing of said piston;

(e) preferably the number of teeth of said toothings being such that $$\frac{Z_1 \times Z_3}{Z_1 \times Z_3 - Z_2 \times Z_4} = \text{negative integer,}$$

wherein $Z_1$—number of teeth of the central gear, $Z_2$—number of teeth of the internal toothing of the piston, $Z_3$—number of teeth of the external toothing of the piston, and $Z_4$—number of teeth of the internal toothing of the housing;

(f) an inlet connection and an outlet connection formed in said housing;

(g) a distributor valve including a first control element and a second control element each having closable control openings, said chambers of variable volumes being connectable with said inlet connection and said outlet connection via said control openings;

(h) the internal toothing of said housing having more teeth than the external toothing of said piston, and (i) said first control element rotating with the number of revolutions of said central gear and said second control element rotating with the number of revolutions of said piston.

The internal toothing of the housing may have by one tooth more than the external toothing of the piston.

The first control element and said second control element may each rotate coaxially with said shaft.

The first control element may be rigidly connected to said shaft, said second control element being rotationally supported on said shaft; the machine further including a parallel crank gear, said second control element being taken along by said piston via said parallel crank gear.

The module (pitch) of each internal toothing in the assembly may be the same.

A gearing between said piston and said central gear may be an Eaton-gearing.

A gearing between said piston and said central gear may be double-cycloidal internal gearing in accordance with Swiss Pat. No. 109,955. The gearing between the piston and the central gear may be also formed in accordance with European patent application No. 0,073,271.

The first and second control elements may be two rotors rotated one with another in a unit, said first control element having twice as many openings as said central gear, said openings being uniformly distributed on said first control element in a circumferential direction, said openings being alternatingly connected with said inlet connection and said outlet connection via passages, said housing including a first annular chamber, said openings being connected to said annular chamber, the openings of said second control element being uniformly distributed thereon in a circumferential direction and being positioned on the same radius as the openings of said first control element, the second control element having as many of said openings as said internal toothing has teeth, said first control element having between the openings intermediate spaces which can cover and release corresponding openings of said second control element so that when a respective opening of the second control element runs through a place of the deepest meshing between said central gear and said piston, this opening is covered by a respective intermediate space of the first control element.

Both control elements in said unit may be circular discs.

The housing may have a second annular chamber connected to said inlet connection, said openings of said first control element being alternatingly connected to said second annular chamber via inclined passages formed in said second control element.

The second control element may be a disc, said shaft being said first control element, said second control element rotating about said first control element, the openings of said first control element being provided in a peripheral outer surface of said shaft, the openings of said second, control element being provided in a bore, in which said second control element is supported on said shaft, and the openings of said second control element being connected to the passages which open into a fluid space formed between said central gear and the internal toothing of said piston.

Those openings of said first control element, which are not connected to said annular chamber in said housing, may be connected to one of the connections of the housing via a central axial passage in said shaft, said annular chamber bypassing said shaft in the housing and being connected to another of said connections of the housing, said annular chamber being connected to respective openings of said first control openings via the axial passage of said shaft.

The machine may further include a pressure disc positioned between a housing portion having said annular chamber and said second control element, said pressure disc having a central region at its side facing away from said second control element, said central region being loaded with pressure which prevails in an annular space between said shaft and said housing.

The inventive improvement of the invention resides in that the piston has on its outer periphery an external toothing concentrical with the internal toothing, that the external toothing is formed, for example by a second toothed gear which is in mesh with an internal toothing fixedly connected to the housing and being concentrical with the central gear and the shaft.

The ratio between the numbers of teeth of the toothings can be obtained from the following formula:

$$\frac{Z_1 \times Z_3}{Z_1 \times Z_3 - Z_2 \times Z_4} = \text{interger (negative)},$$

wherein $Z_1$=number of teeth of the central gear, $Z_2$=number of teeth of the internal toothing of the ring piston, $Z_3$=number of teeth of the external toothing of the ring piston, and $Z_4$=number of teeth of the internal toothing rigidly connected to the housing.

Due to the translation of reaction torques from the gear ring piston to the housing according to the present invention extremely small friction forces occur between the teeth of the gear, and the translation of a peripheral force from a reaction torque to the housing occurs practically by a rolling friction. The feature which resides in that the quotient is a negative integer, is necessary to maintain a continual and repeated control cycle on the distribution valve and to form the smallest possible number of control slots. Thereby a sufficient time cross-section for filling and emptying the displacement space, forming the chambers of variable volumes, is maintained.

The preferable distributor valve is known as the valve operating in accordance with so-called orbit-principle and can be employed in the machine of this invention, in which a first control element of the distributor valve executes the same number of revolutions as the central gear and the second control element of the valve rotates with the same number of revolutions as the ring-shaped gear piston. It is advantageous that both control parts of the distribution valve rotate about the same driving or driven shaft so that a continual overlapping of the control slots is ensured. The arrangement of the control slots in the radial direction ensures that the working fluid can continuously flow into respective working chambers between the central gear and the internal toothing of the piston. Due to circular movements of the gear ring piston by eccentricity amounts about the middle axis of the machine, and particularly the distributor valve system, a radial displacement of the control slots relative to the internal toothing of the piston cyclically takes place. This is very important for correct dimensioning of control slots.

Thereby to ensure the kinematics for a cyclical control of the distributor valve it is advantageous to rigidly connect the first control element with the shaft and to rotationally support the second control element of the valve on the shaft and to drive it by the parallel crank gear of the gear piston. The parallel crank gear does not translate high torques but ensures the kinematics of the distribution valve. Since both control elements of the distributor valve rotate relative to the housing the control openings of the first control element become preferably connected with the fluid inlet and fluid outlet passages, formed on the housing by two axial or two radial turns. It is expedient to provide a sufficient radial play between the shaft and both control elements so as to prevent the shaft, operated under high forces, from having a damaging impact on the distributor valve. The specific advantage of the machine of this invention resides in that substantial radial forces on the stump of the shaft can also occur.

Any number of teeth of the reaction toothing between the ring-shaped piston and the housing can be selected. The number of teeth selected affects absorption volumes of the machine per one rotation of the driving or driven shaft. The slower the piston rotates in the housing the higher is an absorption volume. If it is determined that $Z_3=Z_4$ under predetermined conditions of this invention, which is possible with only one parallel crank gear, then the machine assumes its favorable technical state. The ratio between the number of revolutions of the excentrically positioned gear and that of the central gear, and also of the shaft would be then:

$$Z_1/(Z_1-Z_2).$$

If, for example $Z_1=7$, as is the case of the conventional machine, the relationship between the number of revolutions of the eccentrically positioned gear and that of the shaft would be equal to minus seven. This means that the piston performs the eccentrical and the circular movement seven times in the opposite direction as compared to the movement of the shaft. It can be assumed that the difference in the number of teeth between the piston toothing and the toothing on the housing can be as small as possible. It is advantageous to provide the internal toothing of the housing with one or two teeth more than the external toothing of the piston. In this case it is assumed from the geometric relationship that both internal toothings would have the same module.

When the invention is not limited to a predetermined number of teeth on the central gear this gear should not be small for kinematic reasons because absorption capabilities of the machine are not great. The central gear can preferably have from four to ten, for example from six to nine, and, most advantageously, seven or eight teeth.

If the difference in the number of teeth of the gears of the reaction gearing is two it is advantageous to have both tooth crowns with even number of teeth. In this case the module of the toothing will be half as much.

Many possibilities exist for the selection of the gearing, which forms the displacement chambers. The hollow gear toothing can be further provided with cylindrical rollers which would be formed as teeth inserted into the piston manufactured of powdered material so that with higher number of revolutions a hydrodynamic lubrication film would occur between the rollers and the respective recesses provided in the piston.

Furthermore, the teeth of the toothings for forming the displacement chambers can be epicycloidal or hypocycloidal so that no circular flanks would be produced. This toothing is advantageous in that the entire line of meshing would be a circle, the central point of which would lie between two central points of the central gear and the piston. Thereby a particularly small pressing angle would occur at the place of the deepest tooth engagement, which angle would ensure that the radial component of the tooth force would be specifically small. This would lead to a satisfactory mechanical efficiency.

The toothing disclosed in the European patent application No. 0,073,271 is preferable. In this toothing a considerable engagement-free region exists between the place of the deepest tooth engagement and the place where the flanks of the pinion teeth come in contact so that a displacement space is continually formed by individual tooth gaps. This toothing has the advantage that unavoidable elliptical deformations of the piston due to the influence of high working pressures have a very insignificant effect on the engagement ratio of the toothings.

The novel features which are considered as characteristic for the invention are set forth in particular in the appended claims. The invention itself, however, both as to its construction and its method of operation, together with additional objects and advantageous thereof, will be best understood from the following description of specific embodiments when read in connection with the accompanying drawing.

DETAILED DESCRIPTION OF THE PREFERRED EMBODIMENT

Figure 1:
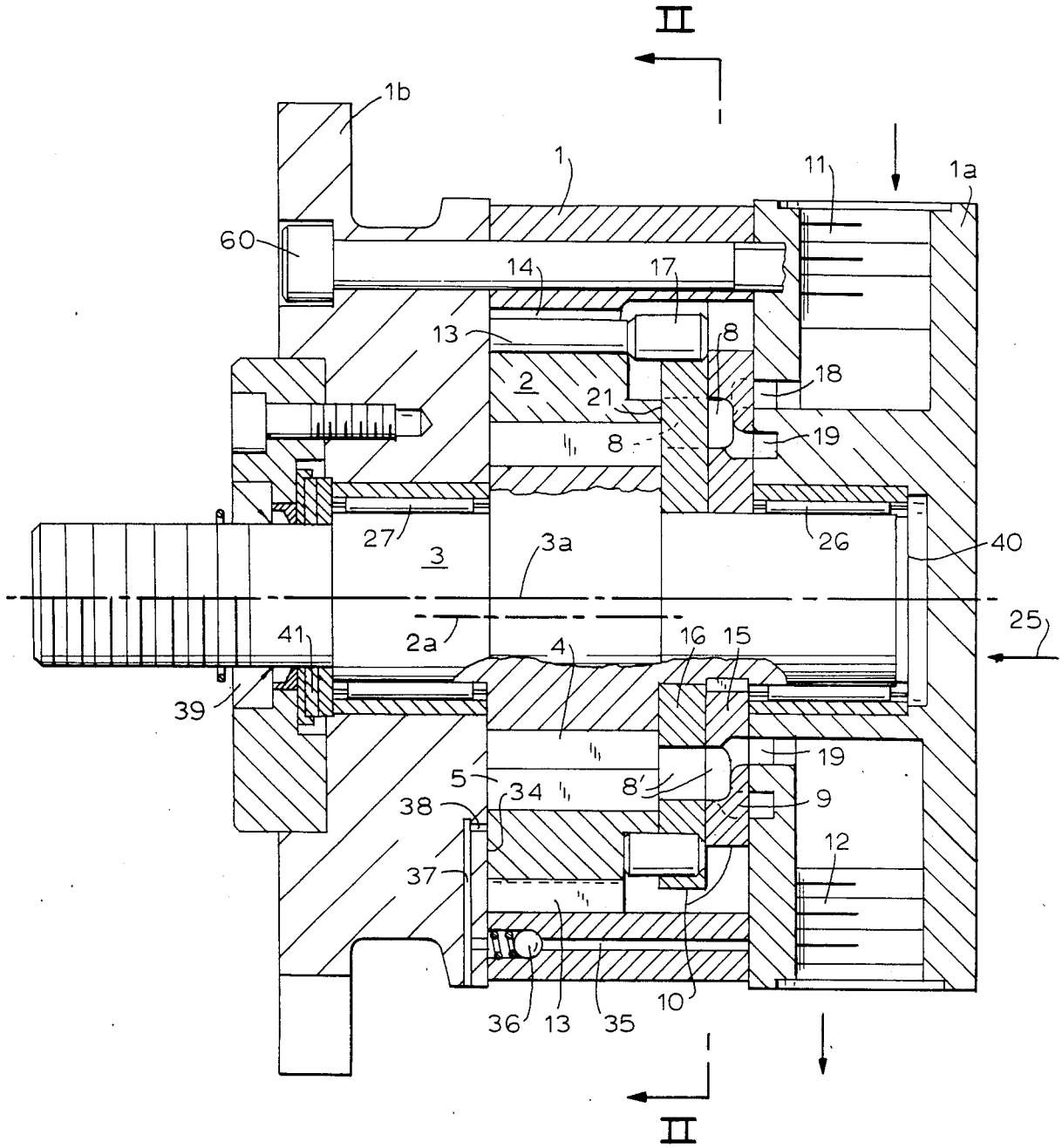
FIG. 1 is an axial sectional view through the machine of the invention.

Referring now to the drawings in detail, and first to FIGS. 1 through 3 and 6 the machine illustrated in these figures may be either a motor or a pump. The machine comprises a housing which includes an intermediate housing ring portion 1, a righthand housing end flange or plate and a left-hand housing end flange 1*b*. All three portions of the housing are centered with each other in a conventional fashion and clamped to each other by means of tension bolts 60, only one of which is shown in FIG. 1 for the sake of clarity.

The housing ring 1 together with the opposite end faces of housing end flanges 1*a* and 1*b* enclose a working chamber in which rotating structural components of the machine are accommodated.

The right-hand flange 1*a* has a feeding passage 11 for admitting a working fluid into the machine and a discharge passage 12 through which the working fluid exits from the machine. Both passages 11 and 12 are connected to respective non-shown conduits.

A first radial annular groove 18, which is concentrical to the axis of rotation 3*a* of a shaft 3, is cut in the inner end face of the housing flange 1*a*, facing the working chamber. A second circular groove 19, also concentrical with the rotation axis of shaft 3, is also formed in the same end face of flange 1*a*. The annular groove 18 opens into the feeding passage 11 while the annular groove 19 is in connection with the discharge passage 12.

As shown in FIG. 1 shaft 3, which can be used in the machine as a driving shaft or a driven shaft, is supported in two end flanges 1*a* and 1*b* by means of needle bearings 26 and 27. A central toothed gear 4 is in this embodiment formed of one piece with the shaft 3.

Figure 3:
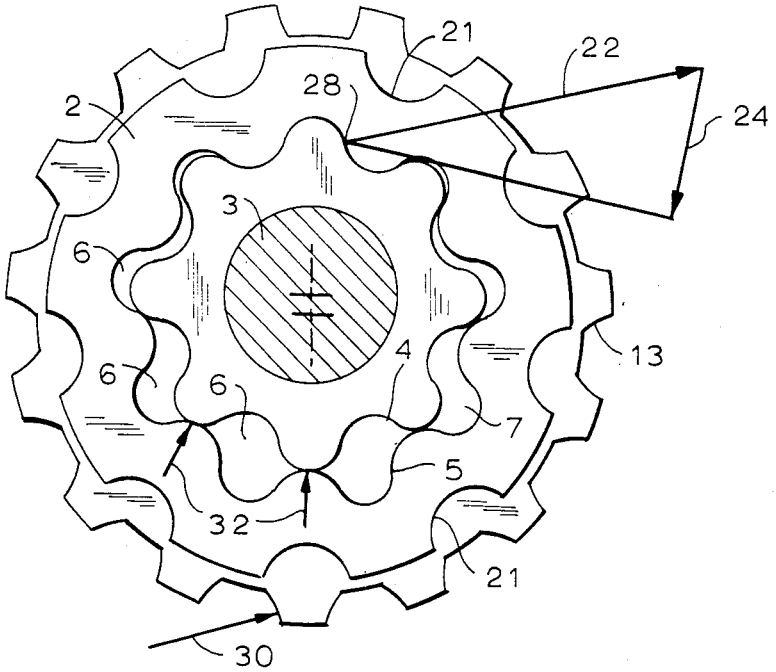
FIG. 3 is a front view of the movable gear tooth system.

With reference to FIG. 3 it will be seen that eight teeth of the central gear 4 concentrically positioned on shaft 3 are in mesh with an internal toothing 5 of the toothed ring which is a gear ring piston 2. The internal toothing 5 of piston 2 has by one tooth more than the central gear 4. The latter also cooperates with the internal toothing of radial piston 2 according to the principle of the Eaton gearing.

Figure 2:
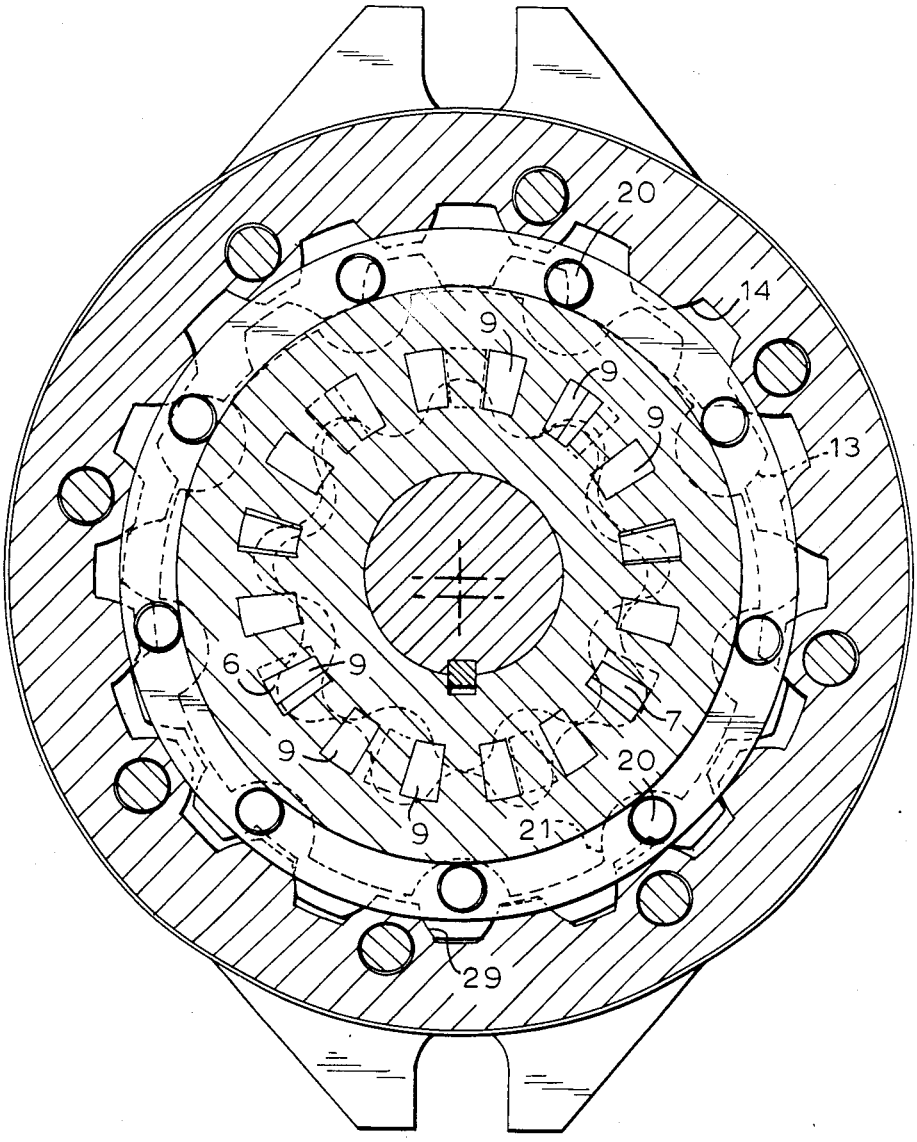
FIG. 2 is a cross-section taken along line II—II of FIG. 1.

As seen from FIG. 2 the gear ring piston 2 carries at its periphery an external toothing 13 which in the exemplified embodiment has 15 teeth. The external toothing 13 of piston 2 is in mesh with an internal toothing 14 rigidly connected to the housing of the machine or provided on the housing itself. The internal toothing 14 has in the exemplified embodiment 16 teeth.

During the rotation of the shaft 3 with the central gear 4 about axis 3*a* the gear ring piston 2 rotates about its axis 2*a* which in turn rotates about axis 3*a*.

Figure 6:
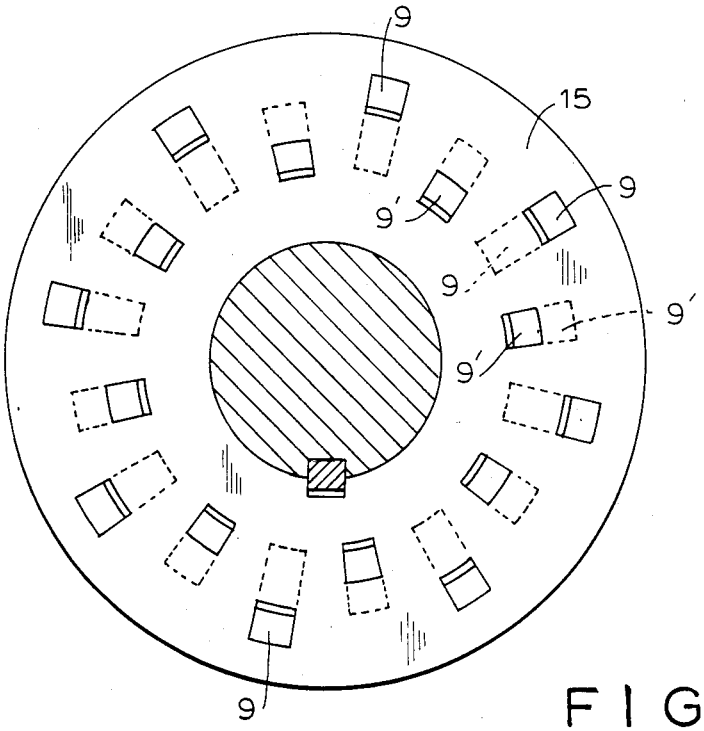
FIG. 6 is a front view of the control disk which rotates with a driving or driven shaft and is connected to that shaft as seen in the direction of arrow 25 of FIG. 1.

A passage of fluid through the machine is controlled by a control valve 17 which includes two main portions, which are control discs 15 and 16, shown in FIGS. 1 and 6. The control disc 15 illustriated in detail in FIG. 6 has sixteen through openings 9, 9′ which are uniformly distributed thereon in the circumferential direction. Through openings 9, 9′ are alternatingly connected with the annular groove 19 or annular groove 18. The control disc 15 is connected to shaft 3 for joint rotation by means of a key shown in FIGS. 1 and 6.

The second control disc 16 which is positioned at the left-hand side of disc 15 is rotationally supported on shaft 3 and has nine slots or through holes 8. The rotation drive of the control disc 16 is provided by the gear ring piston 2. For this purpose control disc 16 has cylindrical pins 20 extended outwardly from the end face of disc 16 and uniformly distributed thereon in the circumferential direction. Cylindrical pins 20 are in engagement with somewhat semi-circular recesses 21 formed on a peripheral surface of a lateral extension of the gear ring piston 2 (the number of the semi-circular recesses corresponds to that of cylindrical pins 20). As can be seen in FIG. 2 this engagement is the deepest when the deepest engagement between the teeth of the radial piston 2 and the teeth of the central gear 4 takes place. In this manner control disc 16 rotates with the number of revolutions of the gear ring piston 2. The control disc 16 has as many slots or through openings 8 as the internal toothing 5 of piston 2 has teeth. Slots 8 are arranged on the same radius as that of the through openings 9 and 9′ of control disc 15. In each relative rotation position both control discs 15 and 16 form, together with openings 9 and 9′, through passages extending into and from volume-adjusting chambers 6, 7.

As can be seen from FIG. 2, control discs 15 and 16 are arranged in such relative rotation position that when the deepest engagement between the teeth of central gear 4 and the teeth of piston 2 takes place the through opening 8, positioned between gear 4 and piston 2, is precisely closed by an intermediate space between two neighboring through openings 9 and 9′. An unobjectionable control of the feeding and discharge flows is provided in this fashion.

The flow admission takes place through openings 9′ whereas the flow discharge is carried out via openings 9 arranged in the circumferential direction between two adjacent openings 9′, openings 9 being in communication with the annular groove 19 which is in turn in connection with the discharge passage 12, as seen from FIG. 1.

It is expedient that the mode of operation of the hydrostatic machine of the invention be described for a slow running hydrostatic motor because such use of the machine is preferable. It is to be understood that the machine of this type can be employed in many cases, for example for hydrostatic steering gears in which such a machine is utilized as a hydraulic pump. In such case shaft 3, on which the central gear 4 is positioned, will be a driving shaft.

Figure 4:
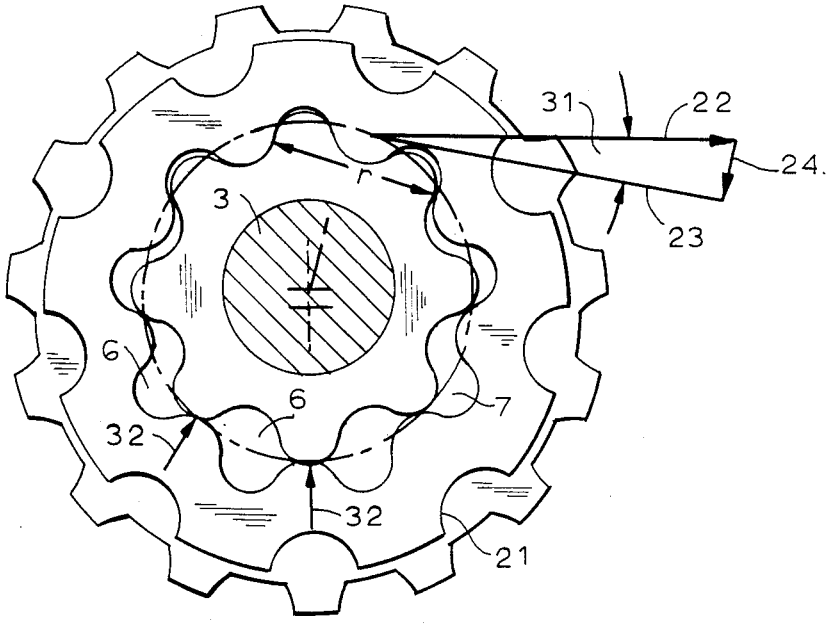
FIG. 4 is a front view of the movable gear assembly but of a modified embodiment of a displacement gear tooth system.
Figure 5:
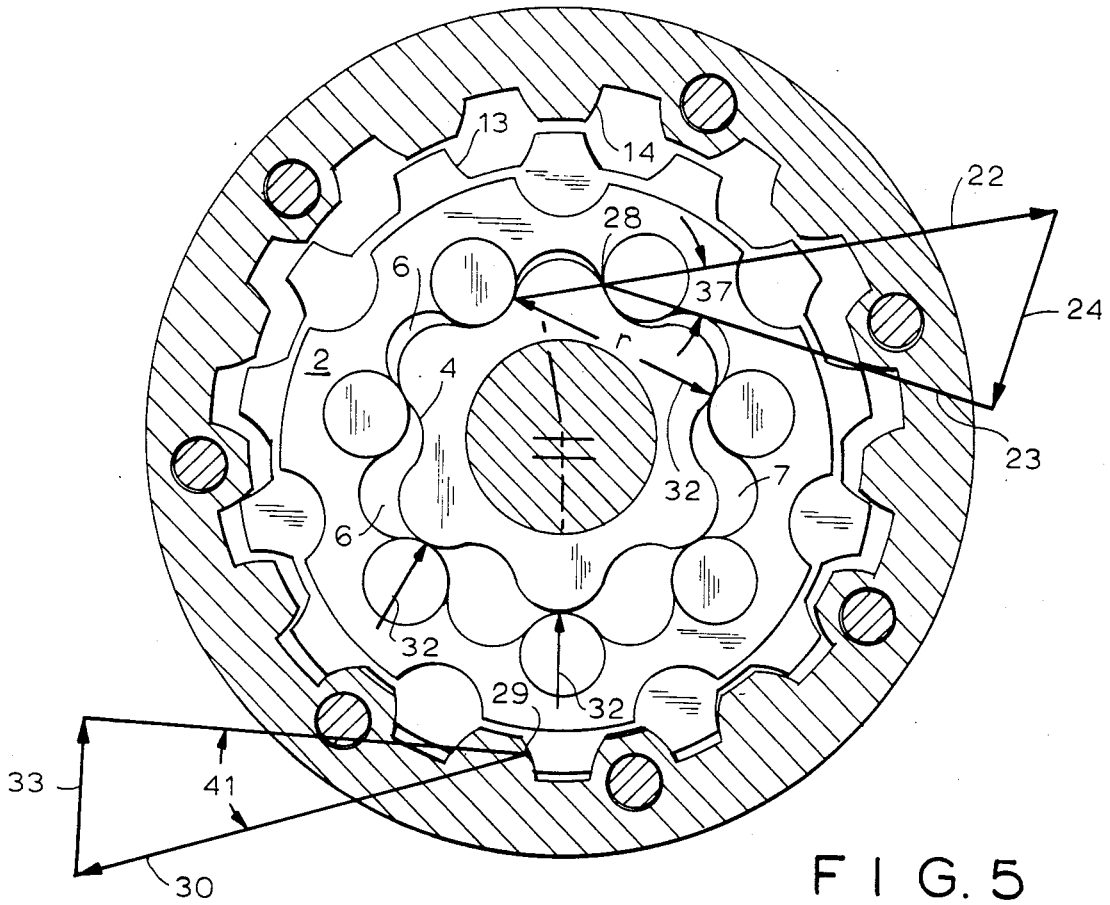
FIG. 5 is a cross-section through the machine with the displacement gear tooth system formed as a conventional Eaton gearing.

In case the machine operates as a slow-running motor the working fluid under pressure enters the machine through the connection passage 11 and is conveyed via the annular groove 18, control openings 9 of the first control disc 15, slots 8 of the second control disc 16 and then into the displacement chamber 6 which in the case of the gear ring machine is subdivided into a plurality of the chambers formed by tooth gaps. The distribution valve 17 provides a continual connection of the annular groove 18, which stands under pressure and is in communication with control slots 9, with the respective control slots 9, and respective control slots 8 of the second control disc 16, which are in connection with tooth chambers 6, which also stand under pressure. The hydraulic pressure in displacement chambers 6 generates together with the effective surface of piston 2, which is calculated from the product of the width of the gear 4 and the diameter of the gear 4, a very great force on the piston 2, the effective line of which extends approximately through the central line of the machine. As can be seen from FIGS. 2 and 5 the gear ring piston 2 has a tendency to move in the leftward direction because the hydraulic force acts on the piston in this direction. Thereby the piston is supported at both places of tooth engagement 28 and 29 and produces in this fashion peripheral forces 22 and 30 which at the engagement spot 29 act in the direction away from the housing and at the engagement spot 28 in the direction towards the central gear 4 rotationally positioned in the housing of the machine. These supporting forces 30 and 22 extend at the angle 31 and 41, which as a whole is substantially dependent from an operational mesh angle of the toothings. As can be seen from FIG. 5, in the case of the Eaton gearing, a radial component of the above-described force is considerably large. In the double-cycloidal displacement toothing, as shown in FIG. 4, this radial force component 24 is substantially smaller because the operational mesh angle 31 is small in the embodiment of FIG. 4.

The displacement toothing shown in FIG. 3 has a mesh angle region which approximately corresponds to the involute gearing. The engagement angle is there constant over the angle of rotation of the central gear 4, as in the example of the Eaton gearing shown in FIG. 5. The radial force component 24 causes an abutment of the teeth of the central gear 4 against the teeth of piston 2 with the deepest engagement at the opposite side and generates thereby flank forces 32 (FIG. 5), which under certain circumstances can lead to considerable friction forces in the circumferential, direction. This can result in the reduction of the efficiency of the machine and an increase in wear. Therefore efforts must be made to maintain the radial force components 24 as small as possible.

A tooth reaction force 30 has a radial compoent 33 which has a tendency to move gear ring piston 2 toward the center of the machine. Both force radial compoents 24 and 33 act on piston 2 in the same direction and generate significant pressures on the displacement gearing 4, 5 by flank forces 32. Although certain flank pressures in the region of the tight mesh in the gear ring toothings are desired at the spot opposite to the deepest engagement, these pressures should not exceed predetermined allowable values. The gearings in such machines should be selected so that they would have the smallest possible operational mesh angle and thus smallest pressure angles 31 and 41. With small differences in the number of teeth of the gears in the internal gearing the trochoidal gearing is particularly advantageous because the operational mesh angle of this gearing can be influenced by the construction better than the involute gearing. When in internal involute toothings the difference between the number of teeth of the meshed gears is only 1 the operational mesh angle considerably increases.

This leads not only to the above mentioned great radial force components of the reaction forces but also to higher friction losses on the flanks of the teeth because of an increased slide speed at the point of engagement.

As can be understood from the above it is possible in the machine according to the invention that the angle of meshing, and therefore friction losses in the machine, be minimized. Potential wear must be also reduced. These advantages are accompanied with certain losses in absorption volumes per one gear revolution because the gear ring piston carries out a slow rotation movement in the same direction as that of the shaft. The number of revolutions of the piston must be than as little as possible. This can be the case when the difference between the numbers of the teeth of the gears of the reaction gearing, comprised of the reaction internal toothing 14 and external toothing 13 is only one. Since both gearings, namely the displacement internal gearing 4, 5 and the reaction gearing 13, 14 must operate with the same eccentricity there is a possibility that the module of both gearings would be identical. It is also possible that the reaction gearing would have a double number of teeth. In such case the module will be halved, and the difference between the numbers of teeth will be 2.

The width of the reaction gearing 13, 14 in the axial direction of the machine must be selected in dependence from the material being selected so that allowable cyclical pressures on the flanks of the teeth would not be exceeded. Efforts should be made to make the gearing as small as possible because the gear ring piston 4 generates a relatively high frequency in the circumferential direction, this frequency causing a fluid displacement effect in the reaction internal toothing. Adulteration work leads, however to pressure losses, particularly with higher number of revolutions of the machine. These losses can be considerably reduced when the chamber, accommodating the gearing is held free from the working fluid.

The execution of the rotation in the distribution valve 17 takes place by means of the annular grooves 18 and 19 and is, because of the length of the machine, also favorable, then the annular groove, which remains under high pressure, generates an axial force on the driving set. Since this annular groove is completely circular it can not be compensated for at the low pressure side of the displacement chambers. Therefore under circumstances it is expedient that an axial compensation, dependent from the direction of rotation of the motor, would be provided via the pressure conduits 35, a check valve 36, a further pressure conduit 37 and an annular groove 38. Therefore potential wear of the surface 34 can be in this fashion reduced.

As can be seen from FIG. 6 the control discs 15, 16 of the control valve are very simple in construction and can be manufactured by a pulverization-metallurgical process. The control disc 16 can be produced in the same fashion and provided with straight through perforations. The short pins 20 of a parallel crank gear 17 for driving the second control disc 16 are merely pressed into this disc. It is, however suggested that axial tolerances for the valve control disc 16 are to be maintained within narrow limits. Pins 20 can be made of one-piece with the control disc 16. In this case pins 20 can be sintered simultaneously with the disc. Semi-circular recesses 21 in the piston 2 can be manufactured as a part of the parallel crank gear for receiving the control disc 16. In favourable situations the gear ring piston 2 can be also produced by a pulverization-metallurgical method so that semi-circular recesses 21 would be sintered at the time of sintering the piston.

The intermediate housing portion 1 can be also produced by the powder-metallurgical process because practically no after-cutting are required.

It is suggested that the driving or driven shaft 3 be supported in the housing by means of roller bearings 26 and 27 so as to enable the motor to start at a higher loading and the number of revolutions 0. In the case of hydrodynamic bearings a solid-state contact would occur, which would cause very high friction losses. Because of small number of revolutions which the shafts of slow-running motors normally have a play in a roller bearing can be maintained relatively small. The rotation piston holds its radial position due to the displacement gearing. It is expedient therefore to determine the tooth flank play of the reaction gearing 13, 14 in accordance with manufacture tolerances so that no forces would result.

It is necessary to take care of leakage oil in order to maintain the space between the toothed gears of the reaction gearing pressureless so as to avoid overloading of seal 39. In many cases a build-up of a predetermined backwash pressure in the low pressure conduit can not be avoided, particularly when a separate leakage oil conduit is not closed. In this case the backwash pressure acts on the end face 40 of shaft 3 and considerable axial bearing forces can be generated. In this case it is suggested to provide an axial bearing 41, and the central gear 4 would not be then made of one piece with the shaft 3 but rather be secured on the shaft against rotation by a notched toothing. Thereby shaft 3 can execute insignificant axial movements within elastic deformations, and no great wear-causing friction forces would occur at the end face 38 between the central gear 4 and the housing.

Figure 7:
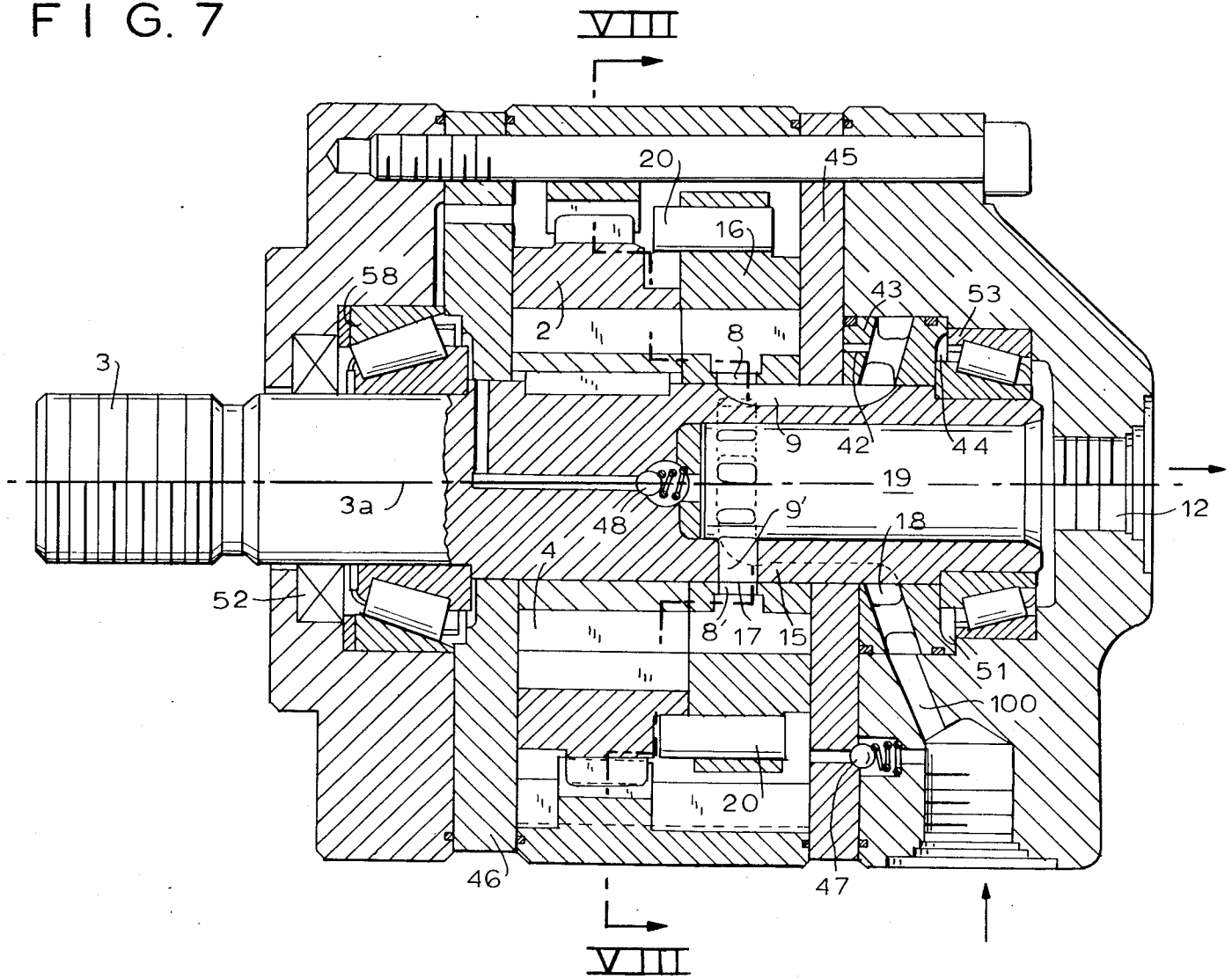
FIG. 7 is an axial sectional view through the machine in accordance with another embodiment of the invention.
Figure 8:
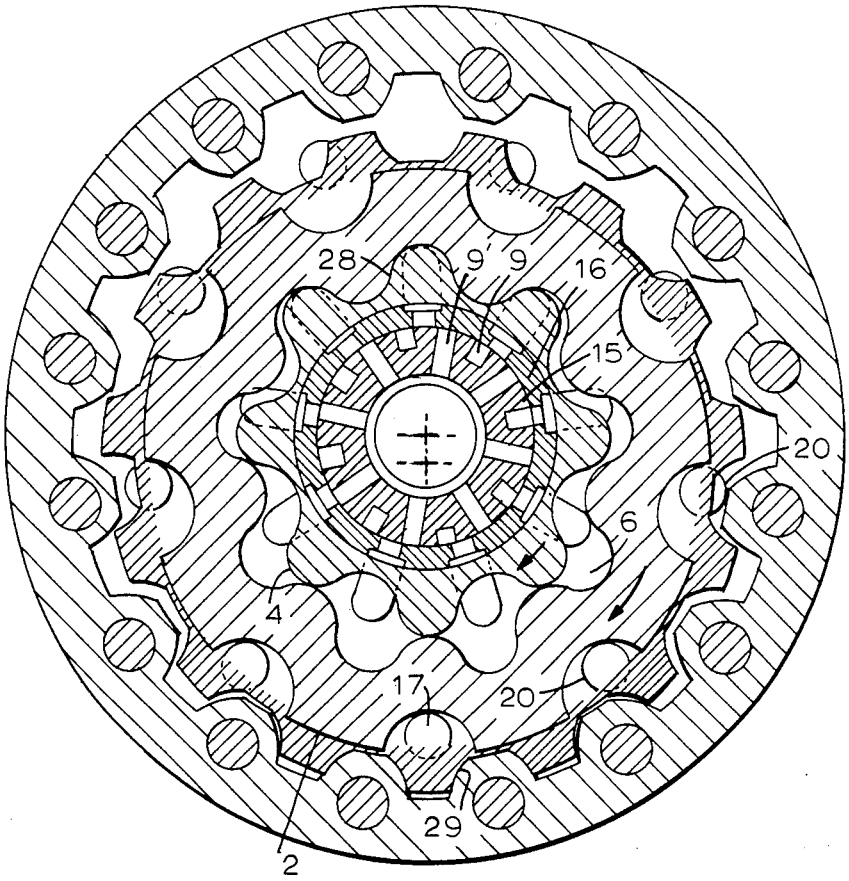
FIG. 8 is a section taken along line VIII—VIII of FIG. 7.

The machine illustrated in FIGS. 7 and 8 has even more advantages than the embodiment shown in FIGS. 1–6. In the embodiment of FIGS. 7 and 8, greater bevel roller bearings are employed and thus the receiving of a higher axial stroke is suggested. The machine can operate in both directions of rotation either as a motor or as a pump. The machine can also operate with substantially higher fluid pressures. The components similar to those shown in FIGS. 1–6 are designated in FIGS. 7 and 8 by the same reference numerals. In this embodiment, however, the first control element of the control valve is shaft 3 whereas the second control element is disc 16 simularly to the embodiment of FIGS. 1 and 2.

In contrast to the embodiment of FIGS. 1 and 2, in the structure of FIGS. 7 and 8 the fluid inlet is provided in a through passage of the second control element or disc 16 but extends not in the axial direction but rather in the radial direction inwardly of disc 16. Respective openings 8 and 8' formed in disc 16 overlap in a corresponding cycle respective openings 9 and 9' of the first control element formed by shaft 3.

It should be assumed that if opening 11 is an inlet opening and the machine operates as a motor high pressure fluid flows in the bore 400 and from there radially into the radial annular chamber 18 formed in an element 51, which chamber is connected via axial grooves 9 formed in shaft 3 with openings 8 of disc 16. From these openings 8 the fluid streams into the working chamber 6 of the machine and then again through openings 8' and openings 9' into the axial bore 19 of shaft 3 which opens into the outlet passage 12.

Passage 11 can form an outlet opening, then passage 12 will operate as an inlet. As seen in FIG. 7 in particular two intermediate plates 45 and 46 are provided, which enable the use of two greater bevel roller bearings 53 which can take up a considerable axial stroke as mentioned above. The element 51 ensures the fluid passage through the machine.

Two check valves 47 and 48 provided for an automatic internal leakage oil connection with respective low pressure passages so that a shaft sealing 52 is continualy unloaded and does not operate under high pressure. Both check valves 47 and 48 ensure respectively flows of the leakage fluid from the space, in which the stationary gear 14 is arranged, into a low pressure conduit.

The directions of rotation are shown in FIG. 8. The second flow direction opposite to that described above is indicated by arrows. The control element 16 of this embodiment differs from the control element of the above described embodiment substantially in that the openings cooperating with the first control element are arranged in the inner radial surface.

Due to the provision of the fluid-passing ring-shaped element 51 an automatic axial pressure compensation for the intermediate plate 45 is possible, also in the both directions of rotation. If, for example high pressure fluid is fed through the radial inlet passage 11 in the embodiment of FIG. 7 the high pressure fluid will pass through bore 42 into an axial pressure field 43 and high pressure will compensate for pressure prevailing in the pressure space 8 of the control element 16 and exerted on plate 45 from its other side. Thereby the intermediate plate 45 will not bend outwardly. In the case of overdimensioning of the pressure field 43 the bending in the inward direction in the case of increase in high pressure can take place, which would lead to a desired reduction of axial play. Thereby ring 51 would be supported on the shoulder 53 of the housing. Bendings occur during operation in the range of elastic deformations and are very minimal. In the opposite direction of rotation high pressure prevailing in the region of passage 12 acts on the end face 44 of ring 51 and presses the intermediate plate 45 inwardly in the same direction.

A relatively large and rigid disc 58 serves the purpose of compensating for axial manufacture tolerances and ensuring a uniform axial clamping of the bevel roller bearings.

It will be understood that each of the elements described above, or two or more together, may also find a useful application in other types of hydrostatic gearing machines differing from the types described above.

While the invention has been illustrated and described as embodied in a hydrostatic gear ring machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydrostatic gear ring machine which can operate as a motor or a pump and comprising:

a housing;

a shaft journalled in said housing; and connected thereto for joint rotation;

a gear ring piston having an internal toothing and being eccentrically positioned relative to said central gear and being rotatable in an orbit around said central gear;

said central gear having an external toothing being in mesh with said internal toothing of said piston and having by one tooth less than said internal toothing so that chambers of variable volumes are formed between said internal toothing and the toothing of said central gear;

said gear ring piston having an outer periphery provided with an external toothing concentrical with said internal toothing, said housing having an internal toothing concentrical with the central gear and being in mesh with the external toothing of said piston;

said internal toothing of said housing having more teeth than the external toothing of said piston;

an inlet connection and an outlet connection formed in said housing;

a distributor valve including a first control element and a second control element each having conrol passages closable by the other control element, said chambers of variable volumes being connectable with said inlet connection and said outlet connection via said control passages;

said first control element being formed by said shaft and said second control element being formed by a disc rotatably journalled on said shaft axially adjacent to said piston;

said disc being rotatable around said shaft by the piston with a rotating speed of said piston by means of protrusions of said second control element, said protrusions extending into recesses on said piston;

said disc having said control passages opening axially into said chambers of variable volumes and radially to the shaft;

said control passages of said shaft and said disc being provided with radial openings, the radial openings of said passages of said shaft being arranged uniformly in one circumferential row opposite to corresponding radial openings of the passages of said disc;

the control passage formed in the shaft being comprised by two groups, the radial openings of a first group being arranged alternatively with the radial openings of a second group, the radial openings of one group being connected through the passages in the shaft with said inlet connection and the other group being connected with said outlet connection.

2. The machine as defined in claim 1, wherein said internal toothing of the housing has by one tooth more than the external toothing of the piston.

3. The machine as defined in claim 1, wherein the numbers of teeth in said toothings are such that $$\frac{Z_1 \times Z_3}{Z_1 \times Z_3 - Z_2 \times Z_4} = \text{negative integer,}$$

wherein $Z_1$ is a number of teeth of said central gear, $Z_2$ is a number of teeth of the internal toothing of the piston, $Z_3$ is a number of teeth of the external toothing of the piston, and $Z_4$ is a number of teeth of the toothing of the housing.

4. The machine as defined in claim 1, wherein said protrusions of said second control element and said recesses on said piston form a gear linkage.

5. The machine as defined in claim 1, wherein the module of each internal toothing is the same.

6. The machine as defined in claim 1, wherein the internal toothing of said piston and the external toothing of said central gear form an Eaton-gearing.

7. The machine as defined in claim 1, wherein the internal toothing of said piston and the external toothing of said central gear form a double-cycloidal internal gearing.

8. The machine as defined in claim 1, wherein said shaft has twice as many passages as said internal toothing of said piston has teeth, said shaft having between said radial openings intermediate surfaces which can cover and release corresponding radial openings of said disc so that when a respective opening of the disc runs through a place of the deepest meshing between said central gear and said piston this opening is covered by a respective intermediate surface of the shaft.

9. The machine as defined in claim 8, wherein the radial openings of one of said groups of passages are connected with an annular chamber in said housing, said annular chamber encompassing said shaft in the housing and being connected to one of said connections of the housing, the passages of said one group being peripheral axial passages formed in said shaft, the radial openings of the other group of said passages being connected to the other of the connections of the housing via a central axis passage in said shaft.

10. The machine as defined in claim 9, further including a pressure disc position between said annular chamber and said disc, said pressure disc having a central region at its side facing away from said disc, said central region being loaded with pressure which prevails in said annular chamber.

* * * * *